US009869473B2

(12) United States Patent
Elkady et al.

(10) Patent No.: US 9,869,473 B2
(45) Date of Patent: Jan. 16, 2018

(54) CONICAL-FLAT HEAT SHIELD FOR GAS TURBINE ENGINE COMBUSTOR DOME

(71) Applicant: GENERAL ELECTRIC COMPANY, Schenectady, NY (US)

(72) Inventors: Ahmed Mostafa Elkady, West Chester, OH (US); Allen Michael Danis, West Chester, OH (US); Eric Matthew Roberson, West Chester, OH (US); Mark Anthony Mueller, Cincinnati, OH (US); George Moertle, West Chester, OH (US); Shui-chi Li, West Chester, OH (US)

(73) Assignee: General Electric Company, Schenectady, NY (US)

( * ) Notice: Subject to any disclaimer, the term of this patent is extended or adjusted under 35 U.S.C. 154(b) by 272 days.

(21) Appl. No.: 14/750,543

(22) Filed: Jun. 25, 2015

(65) Prior Publication Data

US 2015/0377488 A1 Dec. 31, 2015

Related U.S. Application Data

(60) Provisional application No. 62/017,472, filed on Jun. 26, 2014.

(51) Int. Cl.
*F23R 3/50* (2006.01)
*F23R 3/00* (2006.01)

(52) U.S. Cl.
CPC ..... *F23R 3/005* (2013.01); *F23R 3/002* (2013.01); *F23R 3/50* (2013.01); *F23R 2900/03041* (2013.01); *F23R 2900/03042* (2013.01)

(58) Field of Classification Search
CPC .. F23R 3/002; F23R 3/005; F23R 3/50; F23R 2900/03041; F23R 2900/03042
See application file for complete search history.

(56) References Cited

U.S. PATENT DOCUMENTS 5,682,747 A 11/1997 Brown et al.
5,996,335 A 12/1999 Ebel
(Continued)

FOREIGN PATENT DOCUMENTS

EP 2273197 A2 1/2011

OTHER PUBLICATIONS

European Search Report and Opinion issued in connection with corresponding EP Application No. 15172722.9 dated Oct. 28, 2015.

*Primary Examiner* — Steven Sutherland
(74) *Attorney, Agent, or Firm* — General Electric Company; Pamela A. Kachur

(57) ABSTRACT

A gas turbine engine combustor conical-flat heat shield includes an annular conical section extending upstream from and being integral with a flat section with a flat downstream facing surface which may be generally perpendicular to or canted with respect to a centerline. The flat section includes radially outer and inner edges at least one of which is circular and circumscribed about a centerline and circumferentially spaced apart clockwise and counter-clockwise radial edges having an origin on the centerline. A gas turbine engine combustor includes conical-flat heat shields in one or more circular rows arranged in a non-symmetrical or asymmetrical pattern. Two or more groups (A, B, C) of the conical-flat heat shields in the circular rows may be mounted on a domeplate and one or more of the conical-flat heat shields is different in one or more of the groups (A, B, C).

22 Claims, 12 Drawing Sheets

(56) References Cited

U.S. PATENT DOCUMENTS

| | | | | |
|---|---|---|---|---|
| 6,546,733 | B2 | 4/2003 | North et al. | |
| 8,596,071 | B2 | 12/2013 | Mueller et al. | |
| 2004/0237532 | A1 | 12/2004 | Howell et al. | |
| 2007/0256418 | A1 | 11/2007 | Mueller et al. | |
| 2009/0241548 | A1* | 10/2009 | Danis | F23R 3/50 60/747 |
| 2011/0126543 | A1* | 6/2011 | Kirsopp | F23R 3/002 60/742 |

* cited by examiner

CONICAL-FLAT HEAT SHIELD FOR GAS TURBINE ENGINE COMBUSTOR DOME

CROSS-REFERENCE TO RELATED APPLICATIONS

This non-provisional application claims the benefit of priority under 35 U.S.C. §119(e) to U.S. Provisional Patent Application No. 62/017,472, entitled "CONICAL-FLAT HEAT SHIELD FOR GAS TURBINE ENGINE COMBUSTOR DOME", filed Jun. 26, 2014, which is herein incorporated in its entirety by reference.

BACKGROUND OF THE INVENTION

Field of the Invention

This invention relates generally to gas turbine engine combustors and, more particularly, to heat shields on a combustor dome in the gas turbine engine combustor.

Description of Related Art

Air pollution concerns worldwide have led to stricter emissions standards. These standards regulate the emission of oxides of nitrogen (NOx), unburned hydrocarbons (HC), and carbon monoxide (CO) generated as a result of gas turbine engine operation. In particular, nitrogen oxide is formed within a gas turbine engine as a result of high combustor flame temperatures. Making modifications to a gas turbine engine in an effort to reduce nitrous oxide emissions often has an adverse effect on operating acoustic levels of the associated gas turbine engine.

Destructive or undesirable acoustic pressure oscillations or pressure pulses may be generated in combustors of gas turbine engines as a consequence of normal operating conditions depending on fuel-air stoichiometry, total mass flow, and other operating conditions. The current trend in gas turbine combustor design towards low NOx emissions required to meet federal and local air pollution standards has resulted in the use of lean premixed combustion systems in which fuel and air are mixed homogeneously upstream of the flame reaction region. The fuel-air ratio or the equivalence ratio at which these combustion systems operate are much "leaner" compared to more conventional combustors in order to maintain low flame temperatures which, in turn, limits production of unwanted gaseous NOx emissions to acceptable levels.

This method often uses water or steam injection for achieving low emissions, but the combustion instability associated with operation with water or steam injection and at low equivalence ratio also tends to create unacceptably high dynamic pressure oscillations in the combustor that can result in hardware damage and other operational problems. Pressure pulses can have adverse effects on an engine, including mechanical and thermal fatigue to combustor hardware. The problem of pressure pulses has been found to be of even greater concern in low emissions combustors since a much higher percentage of air is introduced to the fuel-air mixers in such designs.

Dry-low-emissions (DLE) combustors are prone to combustion acoustics and typically include design features and/or control logic to reduce the severity of combustion acoustics. These include acoustic damper, multiple fuel systems, and supplemental fuel circuits. Multiple fuel systems allow for flame temperature variation within the combustion chamber. The LM2500 DLE and LM6000 DLE incorporate three rings of premixers that are independently fueled. This allows for the outer, middle, and inner premixers to have different flame temperatures.

Supplemental fuel circuits have been used to inject a relatively small portion of the fuel into the combustor at different locations from the primary injection locations. This out-of-phase fluctuation in heat release serves to reduce the amplitude of the pressure fluctuations. In some implementations, the supplemental fuel also introduces temperature variation within the combustion chamber.

In at least some of the General Electric LM2500 DLE and LM6000 DLE combustors, supplemental fuel is injected from every other premixer. The fuel flow to premixers without supplemental fuel is generally lower than those with the supplemental fuel.

At least some known gas turbine combustors include a plurality of mixers which mix high velocity air with liquid fuels, such as diesel fuel, or gaseous fuels, such as natural gas, to enhance flame stabilization and mixing. At least some known mixers include a single fuel injector located at a center of a swirler for swirling the incoming air. Both the fuel injector and mixer are located on a combustor dome. A typical dome includes a dome plate supporting heat shields. The combustor includes a mixer assembly and heat shields that facilitates protecting the dome. The heat shields are cooled by air impinging on the dome to facilitate maintaining operating temperature of the heat shields within predetermined limits.

During operation, the expansion of the fuel-air mixture flow discharged from a pilot mixer may generate toroidal vortices around the heat shield. Unburned fuel may be convected into these unsteady vortices. After mixing with combustion gases, the fuel-air mixture ignites, and an ensuing heat release can be very sudden. In many known combustors, hot gases surrounding heat shields facilitate stabilizing flames created from the ignition. However, the pressure impulse created by the rapid heat release can influence the formation of subsequent vortices. Subsequent vortices can lead to pressure oscillations within combustor that exceed desirable or acceptable limits.

It is highly desirable to have an effective means for eliminating or reducing these high levels of noise or acoustics in a gas turbine engine combustor, particularly, one that has a short length and is designed for low NOx (nitrous oxides), CO, and unburnt hydrocarbon emissions. It is also highly desirable for this means to be simple to employ or add to already existing engines and to tune it for specific engines and installations. Conical outer and inner heat shields on combustor domes are disclosed in U.S. Pat. No. 8,596,071 issued to Mark Anthony Mueller, et al., Dec. 3, 2013. U.S. Pat. No. 8,596,071 is assigned to the present assignee, General Electric Company, and incorporated herein by reference.

Combustion instability is a challenging problem in DLE combustors in which the fuel is burned in a lean premixed flame. Combustion instability in some cases could create large acoustic pressures that can drive structural vibrations, high heat fluxes to combustor walls, flame flashback (by longitudinal mode) and flame blow-off (by tangential or radial modes). In some extreme cases, the outcome is engine hardware failure. One of the most effective ways to eliminate combustion instability is to anchor the lean-premixed flame on a well-designed flame-holder such that the space lag is outside of instability domain. For this reason, it has been demonstrated that combustor dome heat shield design and shape (as a flame holder) has a paramount effect on driving suppression of combustion acoustics.

BRIEF SUMMARY OF THE INVENTION

A conical-flat heat shield for a gas turbine engine combustor includes an annular conical section extending upstream or forward from and being integral with a substantially annular flat section of the conical-flat heat shield. The flat section includes radially outer and inner edges, at least one of the outer and inner edges is circular and circumscribed about a centerline, and the flat section includes circumferentially spaced apart clockwise and counter-clockwise radial edges having an origin on the centerline.

A flat downstream facing surface of the flat section may be generally perpendicular to or canted at a face angle with respect to a centerline. The conical-flat heat shield may include a cylindrical section upstream from and integral with the annular conical section.

A transition section may be disposed between and integral with the annular conical section and a cylindrical section, the cylindrical section extending upstream or forward from the annular conical section, and a forward end of the transition section may be substantially flush with the cylindrical section and an aft end of the transition section substantially flush with the annular conical section.

The conical-flat heat shield may include film cooling means for cooling a downstream facing surface of the conical-flat heat shield upstream or forward of the flat section. The conical-flat heat shield may include a cooling air plenum disposed between cool wall and hot walls of the conical-flat heat shield upstream or forward of the flat section, cooling air supply holes extending through the cool wall to the cooling air plenum, and upstream angled film cooling holes extending from the cooling air plenum through the hot wall to a downstream facing surface of the conical-flat heat shield upstream or forward of the flat section.

A gas turbine engine combustor includes a domeplate coupled to combustor annular outer and inner liners, one or more concentric circular rows of conical-flat heat shields are mounted on or coupled to the domeplate, and each of the conical-flat heat shields includes an annular conical section extending upstream or forward from and integral with a flat section of the conical-flat heat shield.

The conical-flat heat shields in the one or more circular rows may be arranged in a non-symmetrical or asymmetrical pattern having at least first and second groups of the conical-flat heat shields and at least first and second different ones of the conical-flat heat shields in the first and second groups respectively in at least a single one of the one or more circular rows.

The gas turbine engine combustor may include two or more groups of the conical-flat heat shields in the one or more circular rows of conical-flat heat shields, each of the conical-flat heat shields having one or more design parameters, and at least one of the conical-flat heat shields in a first one of the two or more groups having the one or more design parameters different than the one or more design parameters of the conical-flat heat shields in a second one of the two or more groups. The one or more design parameters may be chosen from a group consisting of total area of the flat downstream facing surfaces along the outer and inner flat sections of each of the conical-flat outer and inner heat shields, half cone angle of the conical section, an axial offset of the flat section or the conical-flat outer and inner heat shields from the domeplate, and clockwise and/or counter-clockwise circumferential tilt angles of the flat downstream facing surfaces of the outer and inner flat sections.

Another embodiment of the gas turbine engine combustor includes two or more concentric circular rows of conical-flat outer and inner heat shields coupled to or mounted on a domeplate of the combustor. The two or more concentric circular rows include at least one pair of radially adjacent outer and inner circular rows of the conical-flat outer and inner heat shields and the conical-flat outer and inner heat shields include annular outer and inner conical sections extending upstream or forward from and integral with outer and inner flat sections of the conical-flat outer and inner heat shields, respectfully.

BRIEF DESCRIPTION OF THE DRAWINGS

The foregoing aspects and other features of the conical-flat heat shield are explained in the following description, taken in connection with the accompanying drawings where.

DETAILED DESCRIPTION OF THE INVENTION

Figure 1:
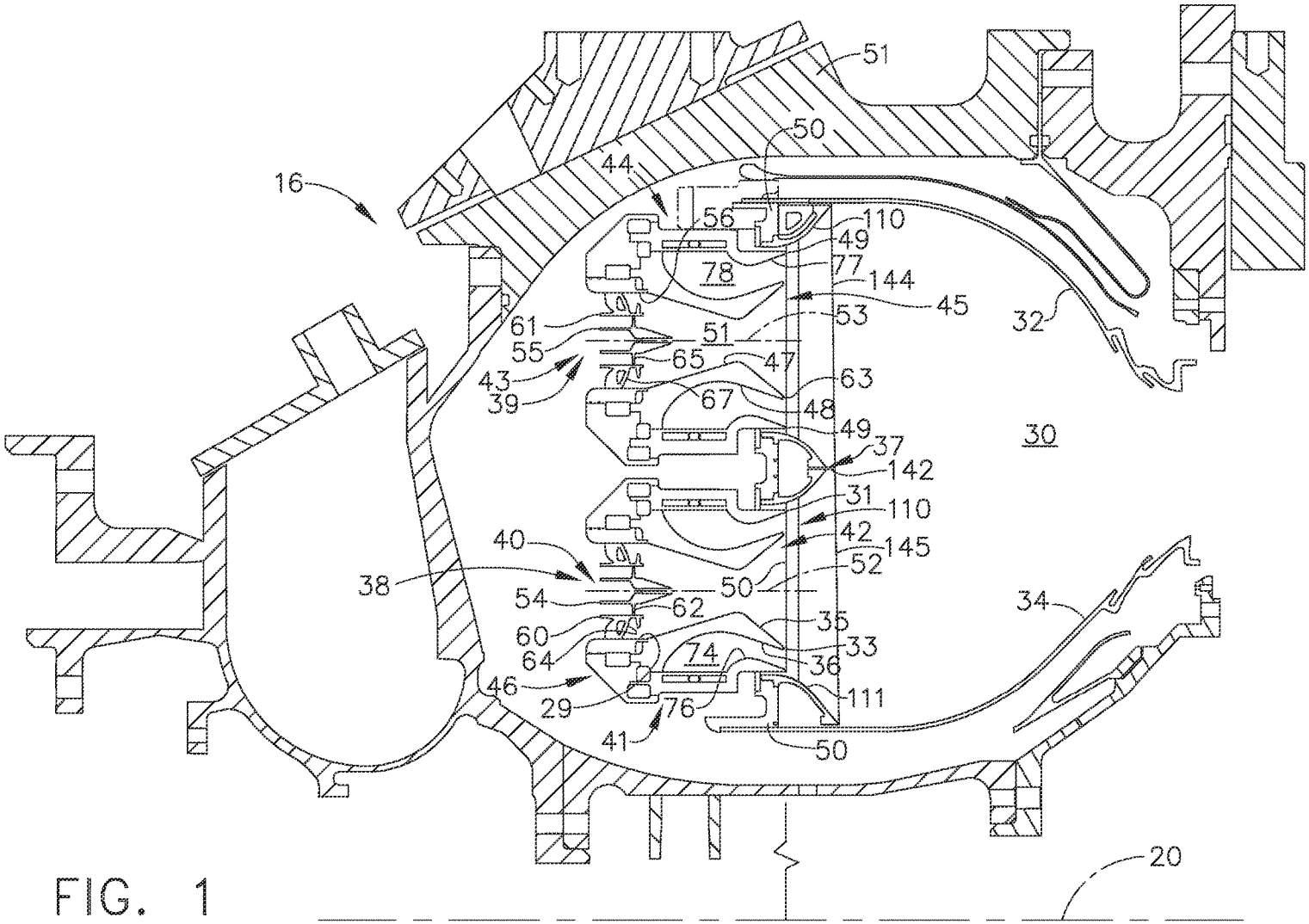
FIG. 1 is a cross-sectional view illustration of an exemplary gas turbine engine combustor with a dome with a conical-flat heat shield.

Referring now to the drawings in detail wherein identical numerals indicate the same elements throughout the figures. FIG. 1 illustrates an exemplary combustor 16 circumscribed about an engine centerline 20. The combustor 16 includes a combustion zone or chamber 30 defined by annular radially outer and inner liners 32, 34 defining outer and inner boundaries respectively of the combustion chamber 30. Center recirculation zones 37 are located in the combustion zone or chamber 30. An annular combustor casing 51 extends circumferentially around the outer and inner liners 32, 34.

Referring to FIG. 1, the combustor 16 includes a dome 46 having an annular domeplate 50 mounted or coupled to the outer and inner liners 32, 34 upstream from the combustion chamber 30 defining an upstream end of combustion chamber 30. At least two mixer assemblies extend upstream from the domeplate 50 to deliver a mixture of fuel and air to combustion chamber 30. The exemplary embodiment of the combustor 16 disclosed herein includes a radially inner mixer assembly 38 and a radially outer mixer assembly 39 and is known as a dual annular combustor (DAC). Alternatively, combustor 16 may be a single annular combustor (SAC) or a triple annular combustor (TAC).

Generally, each of the inner and outer mixer assemblies 38, 39 includes a pilot mixer 43, a main mixer 41, and an annular centerbody 45 extending therebetween. Specifically, in the exemplary embodiment, inner mixer assembly 38 includes an inner pilot mixer 40, an inner main mixer 41 having a trailing edge 31, and an inner annular centerbody 42 extending between the inner main mixer 41 and the inner pilot mixer 40. Similarly, the outer mixer assembly 39 includes an outer pilot mixer 43, an outer main mixer 44 having an outer trailing edge 49, and an outer annular centerbody 45 extending between the outer main mixer 44 and the outer pilot mixer 43. The inner annular centerbody 42 includes a radially inner surface 35 and a radially outer surface 36 with respect to an inner centerline 52, a leading edge 29, and a trailing edge 33. In the exemplary embodiment, radially inner surface 35 is convergent-divergent, and radially outer surface 36 extends arcuately to trailing edge 33. More specifically, inner surface 35 defines a flow path for inner pilot mixer 40, and outer surface 36 defines a flow path for main mixer 41. An inner pilot centerbody 54 is substantially centered within the inner pilot mixer 40 with respect to the inner centerline 52.

Similarly, the outer centerbody 45 includes a radially inner surface 47 and a radially outer surface 48 with respect to an outer centerline 53, a leading edge 56, and a centerbody trailing edge 63. In the exemplary embodiment, radially inner surface 47 is convergent-divergent and radially outer surface 48 extends arcuately to trailing edge 63. More specifically, inner surface 47 defines a flow path for outer pilot mixer 43, and outer surface 48 defines a flow path for main mixer 44. An outer pilot centerbody 55 is substantially centered within an outer pilot mixer 43 with respect to the outer centerline 53.

The inner mixer assembly 38 includes a pair of concentrically mounted swirlers 60. More specifically, in the exemplary embodiment, swirlers 60 are axial swirlers and each includes an integrally-formed inner swirler 62 and an outer swirler 64. Alternatively, pilot inner swirler 62 and pilot outer swirler 64 may be separate components. The inner swirler 62 is annular and circumferentially disposed around the inner pilot centerbody 54. The outer swirler 64 is circumferentially disposed between pilot inner swirler 62 and radially outer surface 36 of centerbody 42.

In the exemplary embodiment, pilot inner swirler 62 discharges air swirled in the same direction as air flowing through pilot outer swirler 64. Alternatively, pilot inner swirler 62 may discharge swirled air in a rotational direction that is opposite a direction that pilot outer swirler 64 discharges air.

The main mixer 41 includes an outer throat surface 76, that in combination with centerbody radially inner surface 35, defines an annular premixer cavity 74. In the exemplary embodiment, centerbody 42 extends into combustion chamber 30. Main mixer 41 is concentrically aligned with respect to pilot mixer 40 and extends circumferentially around inner mixer assembly 38. In the exemplary embodiment, a radially outer throat surface 76 within main mixer 41 is arcuately formed and defines an outer flow path for main mixer 41.

Similarly, outer mixer assembly 39 includes a pair of concentrically mounted swirlers 61. More specifically, in the exemplary embodiment, swirlers 61 are axial swirlers and each includes an integrally-formed inner swirler 65 and an outer swirler 67. Alternatively, pilot inner swirler 65 and pilot outer swirler 67 may be separate components. Inner swirler 65 is annular and is circumferentially disposed around pilot centerbody 55, and outer swirler 67 is circumferentially disposed between pilot inner swirler 65 and radially outer surface 48 of centerbody 45.

In the exemplary embodiment, pilot inner swirler 65 discharges air swirled in the same direction as air flowing through pilot outer swirler 67. Alternatively, pilot inner swirler 65 may discharge swirled air in a rotational direction that is opposite a direction that pilot outer swirler 67 discharges air. Main mixer 44 includes an outer throat surface 77, that in combination with centerbody radially inner surface 47, defines an annular premixer cavity 78. In the exemplary embodiment, centerbody 45 extends into combustion chamber 30. In the exemplary embodiment, a radially outer throat surface 77 within pilot mixer 43 is arcuately formed and defines an outer flow path for pilot mixer 43. Main mixer 44 is concentrically aligned with respect to pilot mixer 43 and extends circumferentially around outer mixer assembly 39.

Referring to FIGS. 1-6 and 14, the exemplary embodiment of combustor 16 and dome 46 includes conical-flat outer and inner heat shields 110, 111 mounted on or coupled to the domeplate 50 and arranged in radially adjacent and concentric outer and inner circular rows 140, 141 respectively. The outer and inner heat shields 110, 111 include annular outer and inner conical sections 142, 143 extending upstream or forward from and integral with outer and inner flat sections 144, 145 respectfully. Flat downstream facing surfaces 222 of the outer and inner flat sections 144, 145 are generally perpendicular to or canted at a face angle 154 with respect to the engine centerline 20. The outer and inner conical sections 142, 143 are centered around and circumscribe the outer and inner centerlines 53, 52 respectively.

Figure 4:
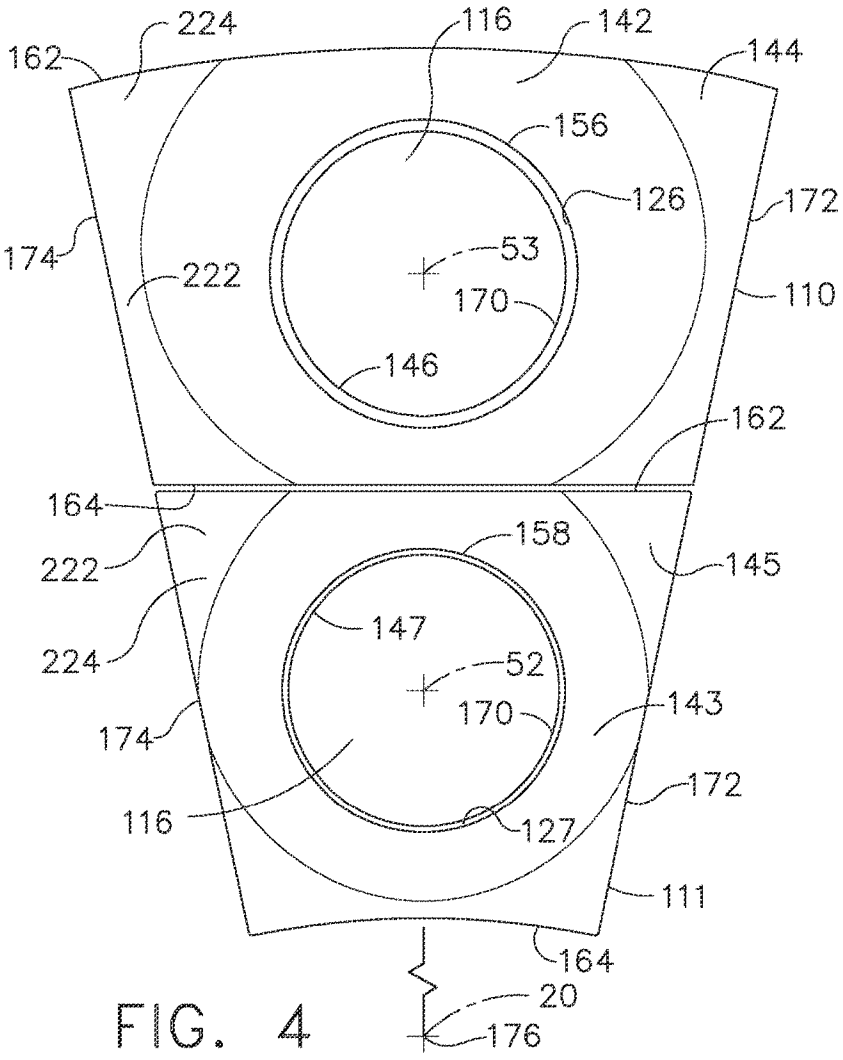
FIG. 4 is an elevated aft looking forward view illustration of the radially inner and outer heat shields illustrated in FIG. 3.
Figure 3:
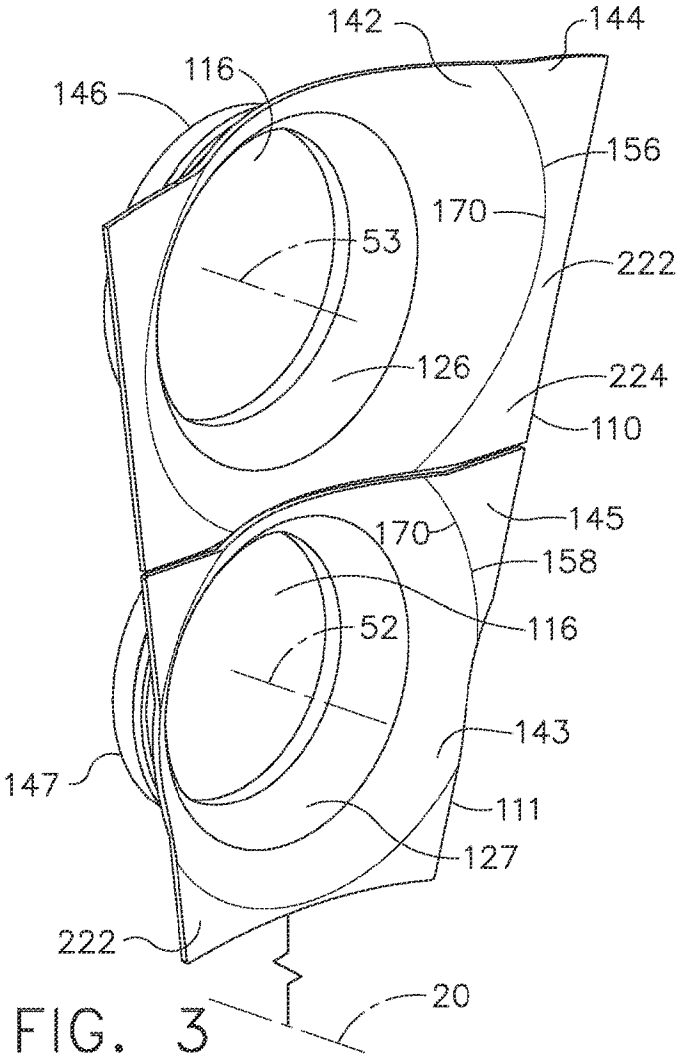
FIG. 3 is a perspective view illustration of radially inner and outer heat shields illustrated in FIG. 2.
Figure 6:
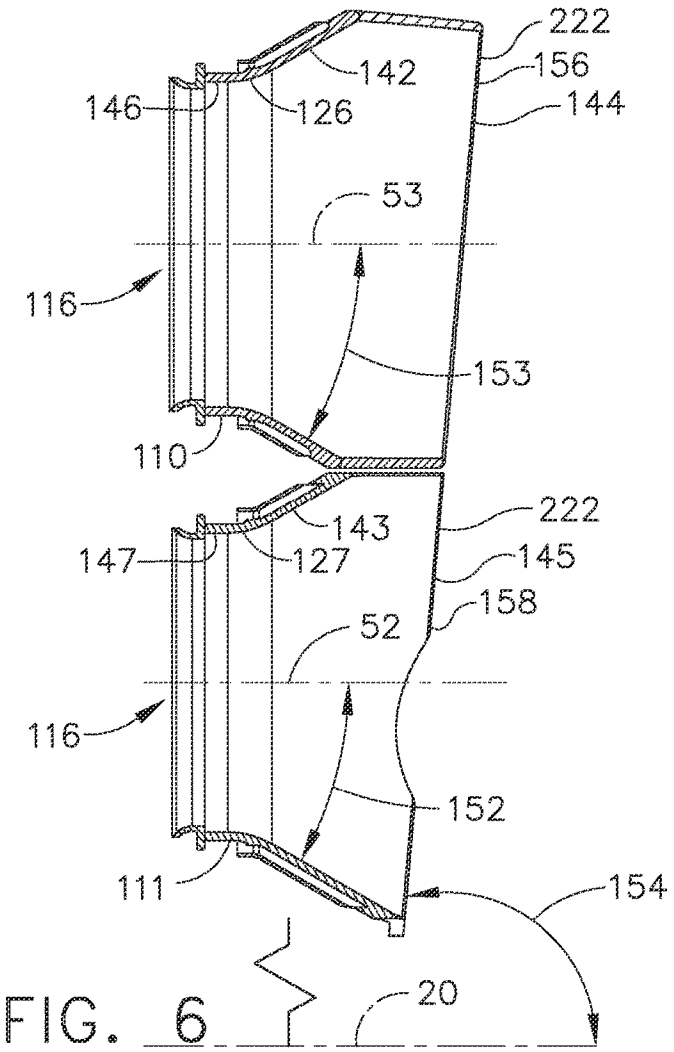
FIG. 6 is a cut-away side view illustration of the inner and outer heat shields illustrated in FIG. 3.
Figure 5:
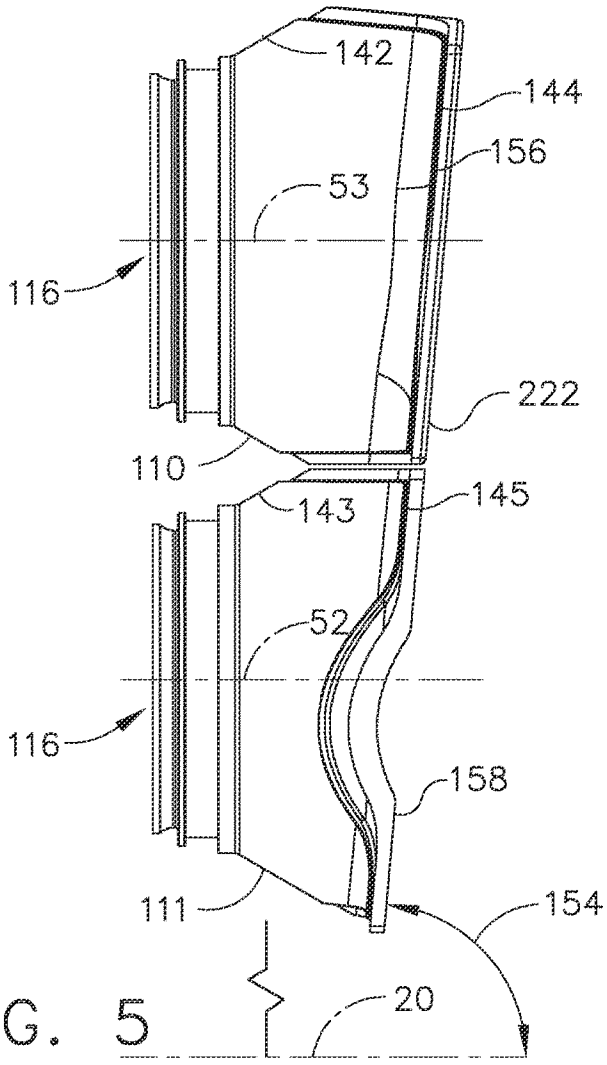
FIG. 5 is a side view illustration of the inner and outer heat shields illustrated in FIG. 3.
Figure 8:
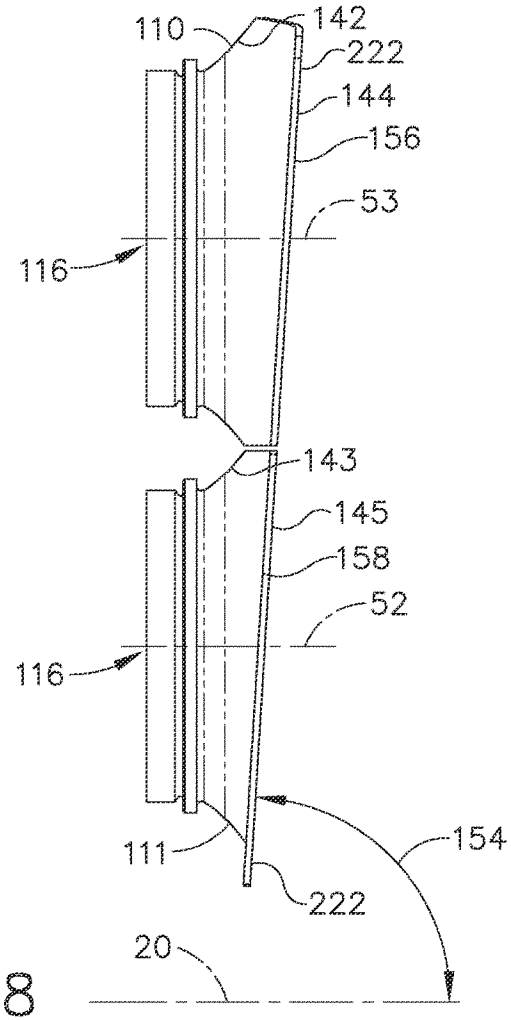
FIG. 8 is a side view illustration of the first alternative embodiments of the inner and outer heat shields illustrated in FIG. 7.
Figure 7:
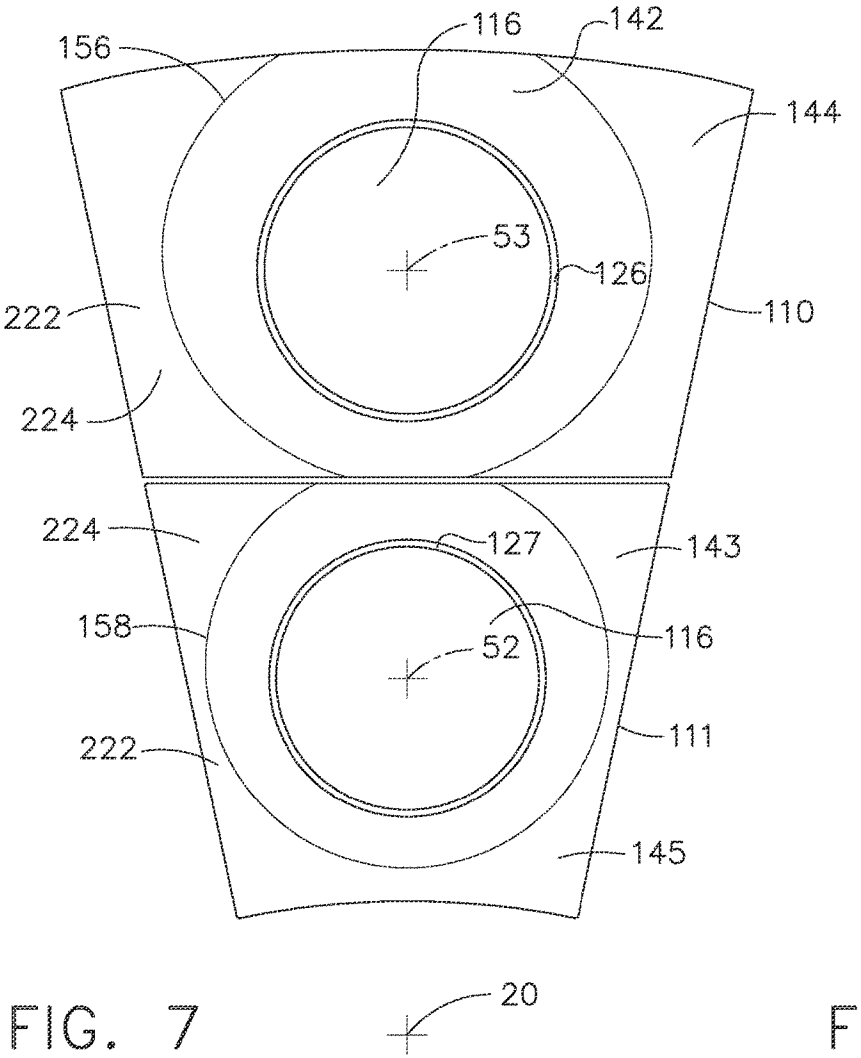
FIG. 7 is an elevated aft looking forward view illustration of first alternative embodiments of the radially inner and outer heat shields illustrated in FIG. 3.
Figure 10:
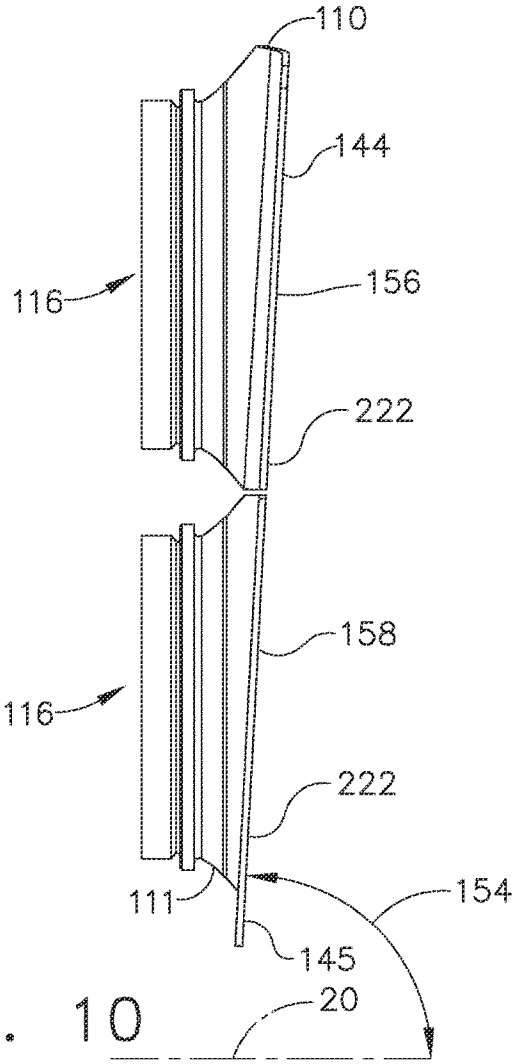
FIG. 10 is a side view illustration of the second alternative embodiments of the inner and outer heat shields illustrated in FIG. 9.
Figure 9:
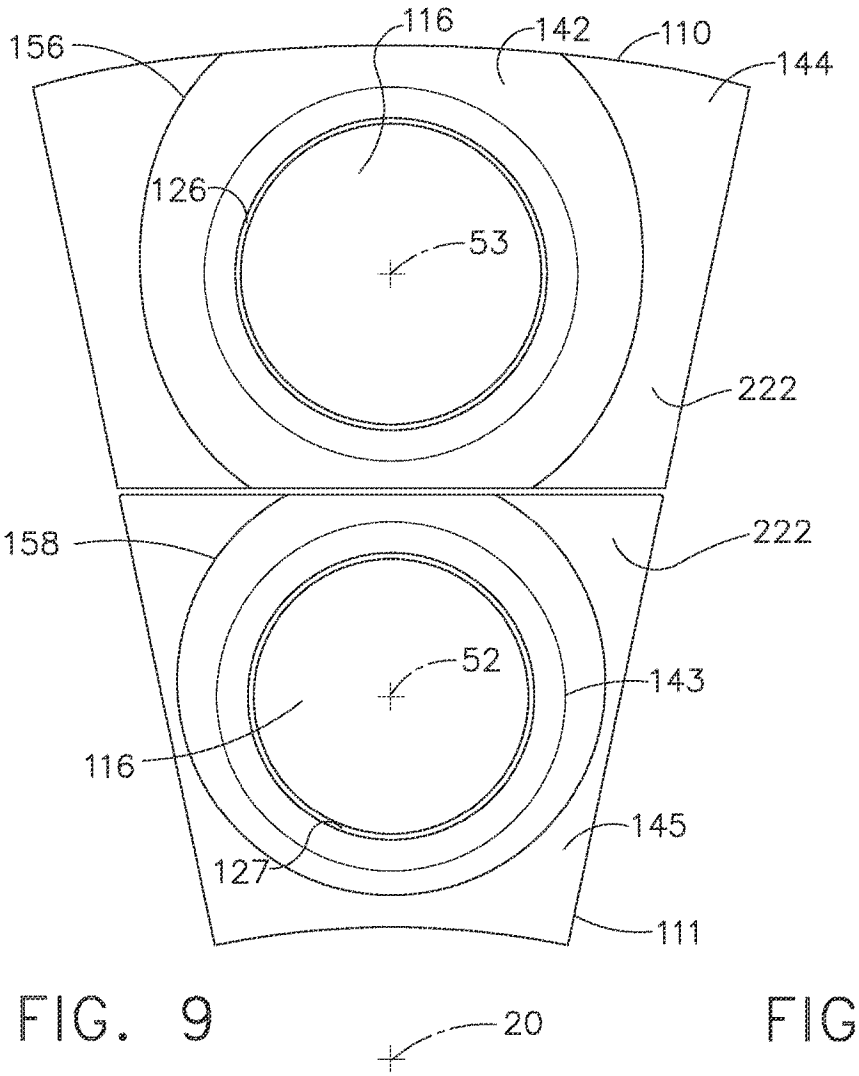
FIG. 9 is an elevated aft looking forward view illustration of second alternative embodiments of the radially inner and outer heat shields illustrated in FIG. 3.

As particularly illustrated in FIG. 4, the outer and inner flat sections 144, 145 are substantially annular with respect to the engine centerline 20. The outer and inner flat sections 144, 145 include radially outer and inner edges 162, 164 of which at least one is circular and circumscribed about the engine centerline 20. The outer and inner flat sections 144, 145 have circumferentially spaced apart clockwise and counter-clockwise radial edges 172, 174 having an origin 176 on the engine centerline 20.

Figure 13:
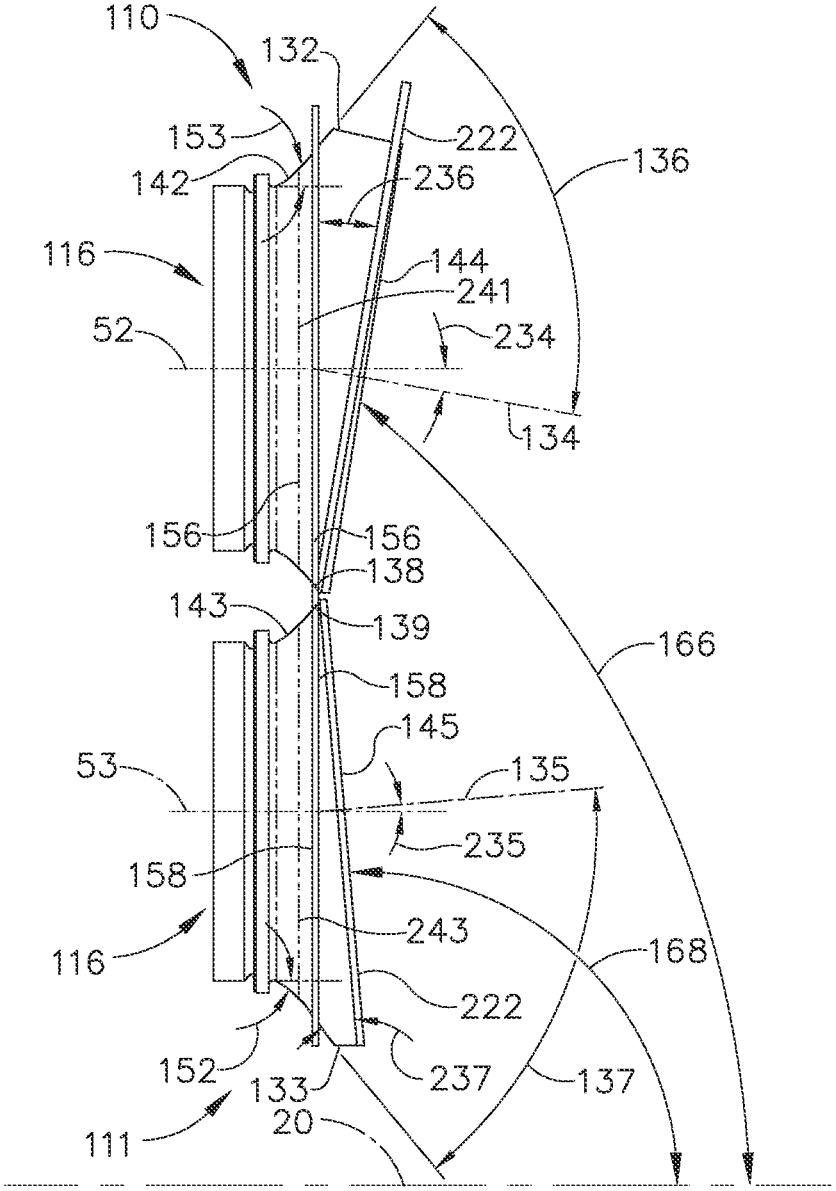
FIG. 13 is a side view illustration of third alternative embodiments of the inner and outer heat shields illustrated in FIG. 1 having inner and outer flat sections respectively canted at different angles with respect to the engine centerline.
Figure 14:
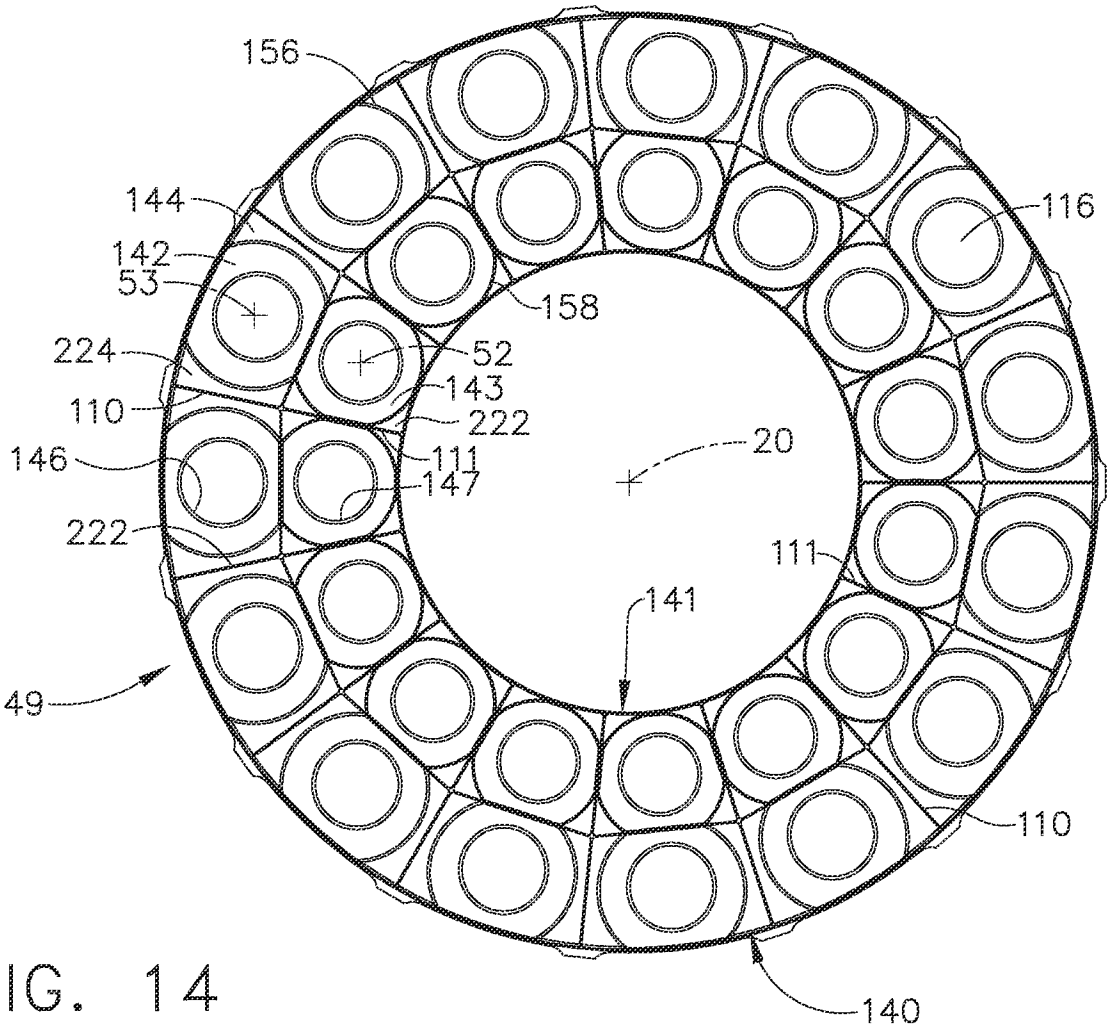
FIG. 14 is an elevated aft looking forward schematical view illustration of the radially inner and outer heat shields illustrated in FIG. 1.

The flat downstream facing surfaces 222 of the outer and inner flat sections 144, 145 may be canted at different outer and inner face angles 166, 168 with respect to the engine centerline 20 as more particularly illustrated in FIG. 13. For example, the flat downstream facing surfaces 222 of the outer flat sections 144 may be canted at an outer face angle 166 towards the engine centerline 20 and the flat downstream facing surfaces 222 of the inner flat sections 145 may be canted at inner face angle 168 away from the engine centerline 20 as illustrated in FIG. 13.

Referring to FIGS. 2-6, the outer and inner flat sections 144, 145 extend radially away (with respect to the outer and inner centerlines 53, 52) from downstream ends or circular outer and inner rims 156, 158 of the outer and inner conical sections 142, 143. Cut out portions 130 of or voids in the outer conical sections 142 where they intersect the radially outer liner 32 may be used to avoid interference between the outer conical sections 142 and the radially outer liner 32 as illustrated in FIG. 2A. It is important to maintain the structural integrity of the liners so the cut out portions 130 or voids are used in the outer conical sections 142.

Figure 11:
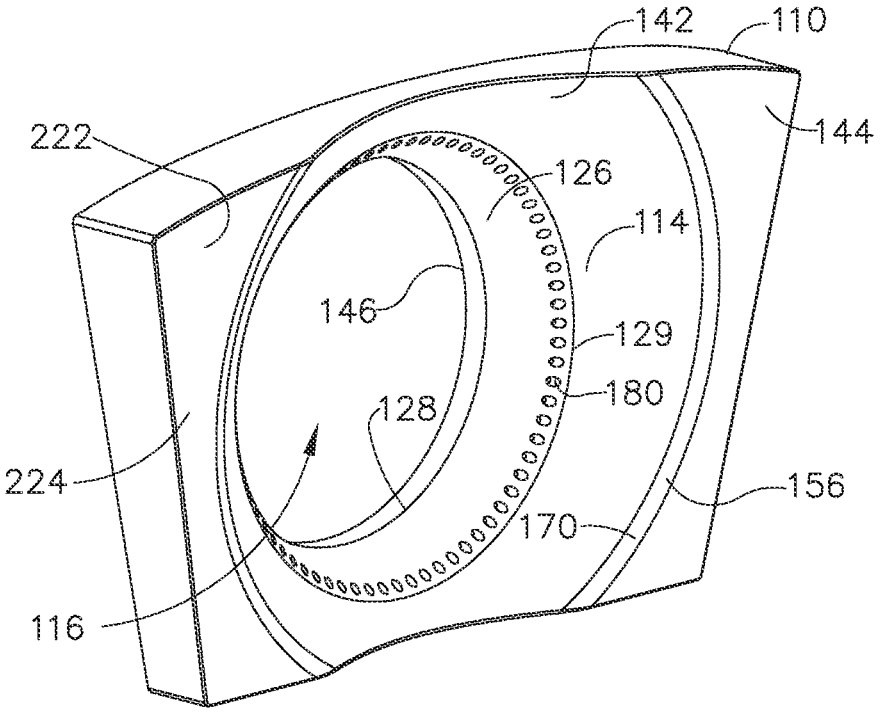
FIG. 11 is a perspective view illustration of film cooling holes for cooling a downstream facing surface of a conical section of an exemplary conical-flat heat shield.
Figure 12:
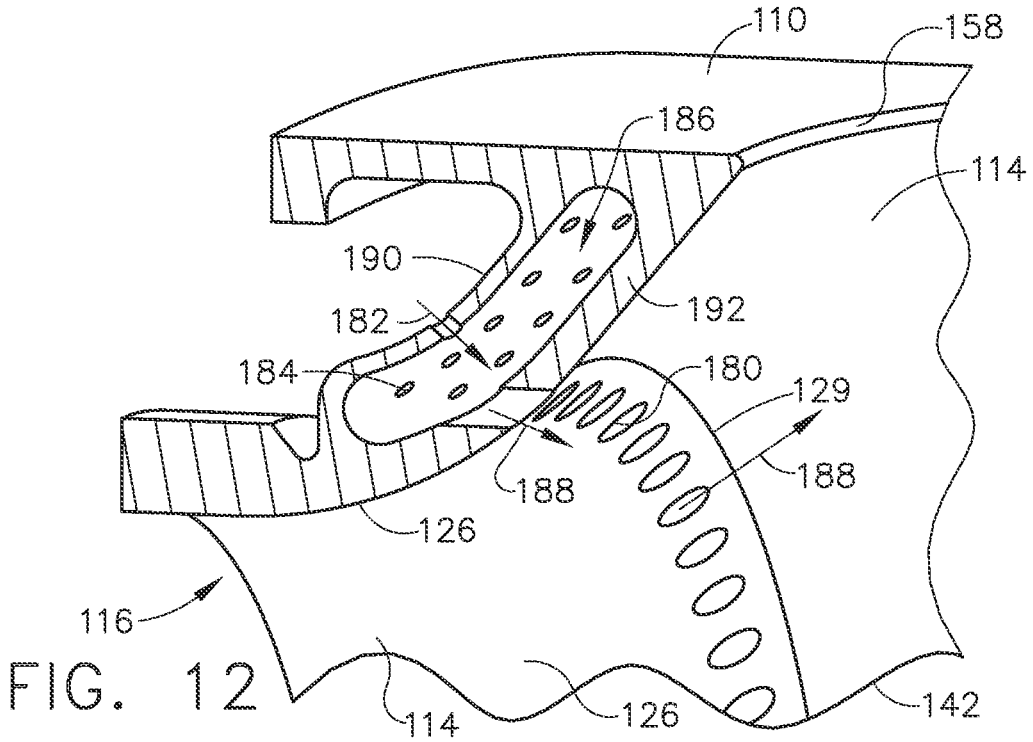
FIG. 12 is a cut-away perspective view illustration of a cooling air plenum for supplying cooling air to the film cooling holes illustrated in FIG. 11.

The exemplary embodiment of the outer and inner heat shields 110, 111 include annular outer and inner cylindrical sections 146, 147 extending upstream or forward from and integral with the outer and inner conical sections 142, 143 respectively Annular rounded outer and inner transition sections 126, 127 disposed between the outer and inner cylindrical sections 146, 147 and the outer and inner conical sections 142, 143 respectively helps to allow the airflow in the heat shields to flow efficiently with a minimum of losses due to separation. This is also illustrated in FIGS. 11 and 12. The transition sections flare radially outwardly in the axially aft or downstream direction. Forward ends 128 of the outer and inner transition sections 126, 127 are substantially flush with the outer and inner cylindrical sections 146, 147 and aft ends 129 of the outer and inner transition sections 126, 127 are substantially flush with the outer and inner conical sections 142, 143 respectively.

The conical-flat outer and inner heat shields 110, 111 with outer and inner flat sections 144, 145 may be contrasted to radially outboard sections of the conical outer and inner heat shields along outer and inner perimeters disclosed in U.S. Pat. No. 8,596,071 issued to Mark Anthony Mueller, et al., Dec. 3, 2013. The conical outer and inner heat shields in U.S. Pat. No. 8,596,071 do not have flat sections or flat corners facing the combustion zone.

Figure 2:
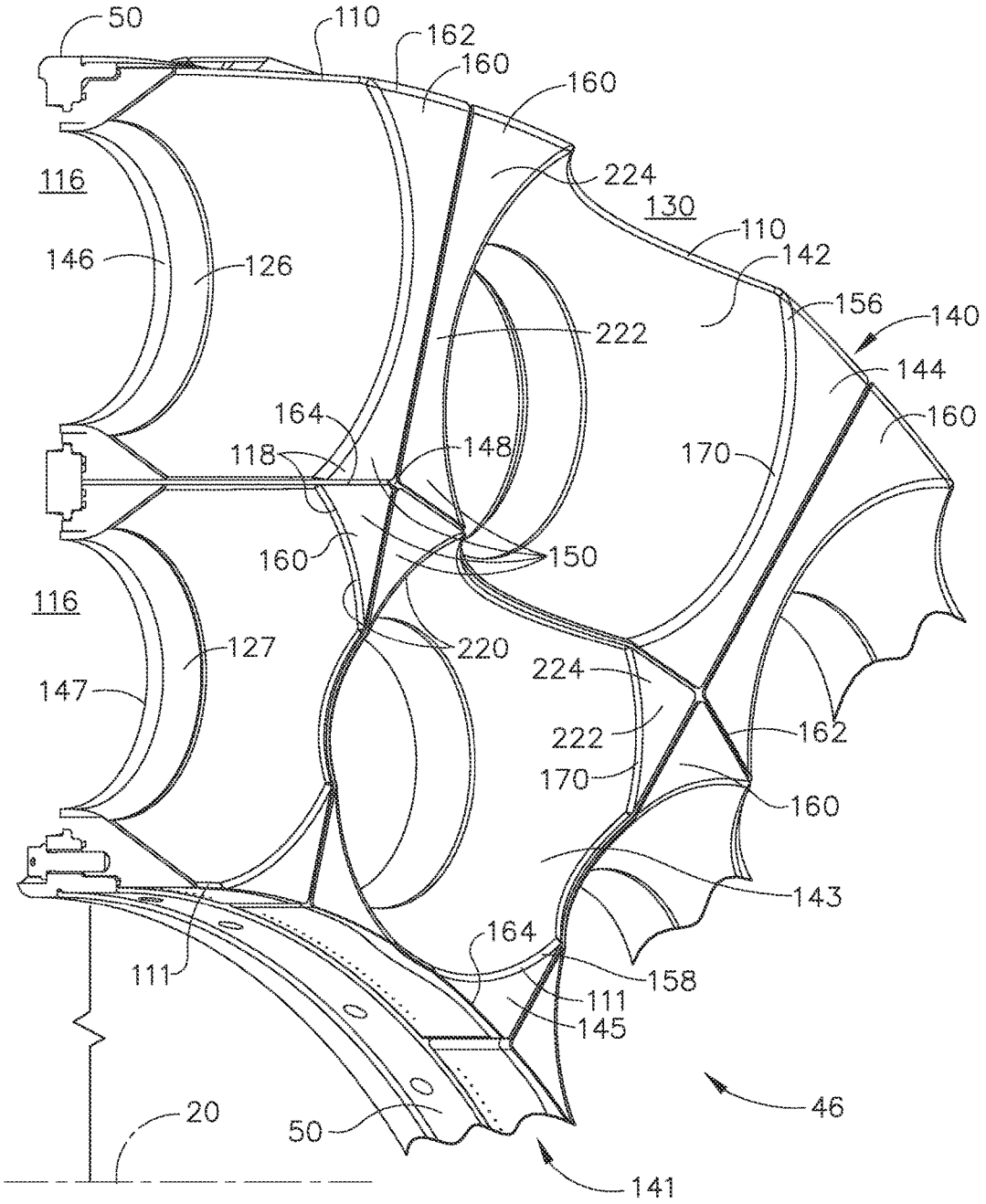
FIG. 2 is a cut-away perspective view illustration of a sector of the dome and exemplary conical-flat heat shields illustrated in FIG. 1.
Figure 2A:
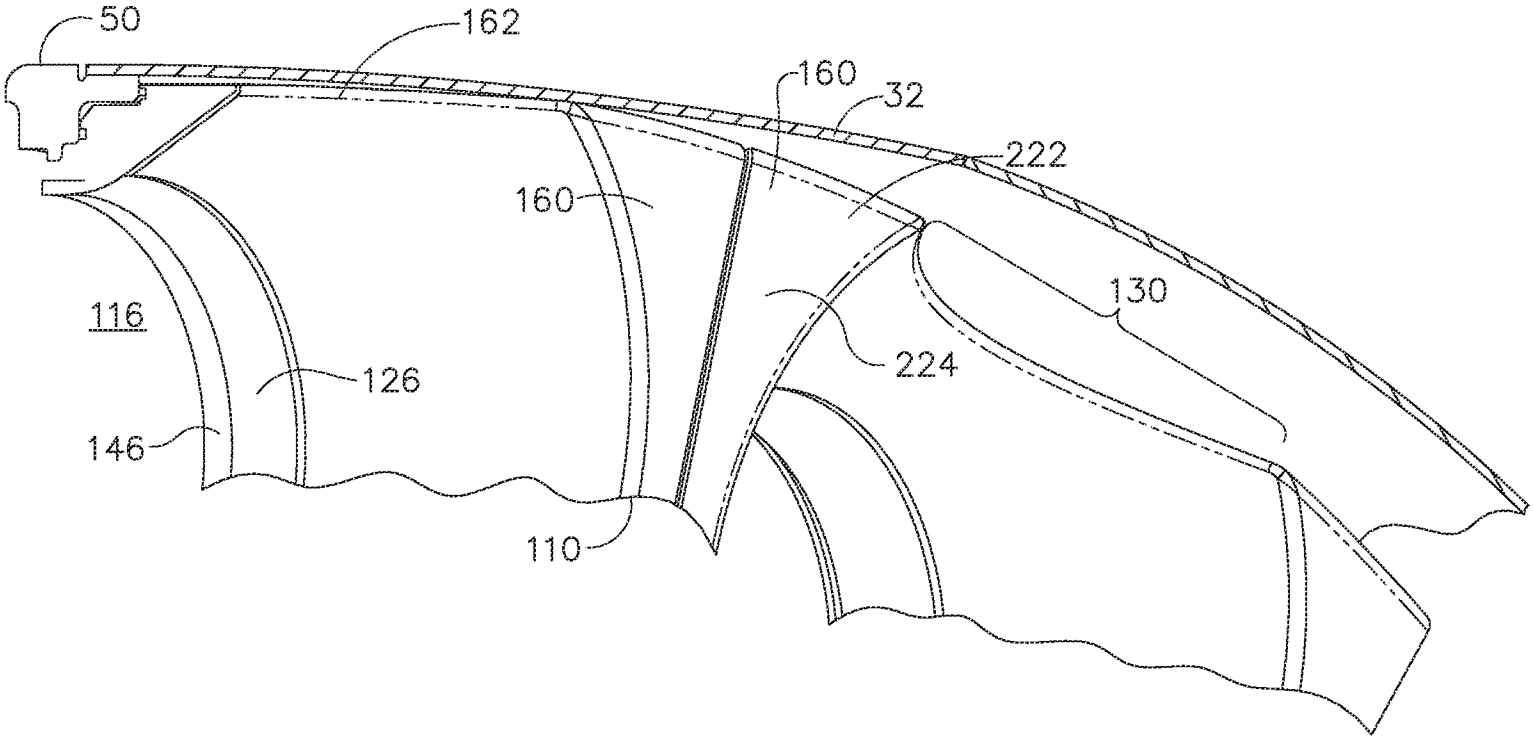
FIG. 2A is an enlarged cut-away perspective view illustration of a portion of the dome and the exemplary conical-flat heat shields and a portion of an outer combustor liner surrounding a portion of the conical-flat heat shields illustrated in FIGS. 1 and 2.

Referring to FIG. 2, flat corners 160 of the outer and inner flat sections 144, 145 of the outer and inner heat shields 110, 111 along the radially outer and inner edges 162, 164 of the outer and inner heat shields 110, 111 respectively provide flat surfaces to stabilize the flame. The flat corners 160 include flat flame stabilizing corner surfaces 224 which are at least part of the flat downstream facing surfaces 222 of the outer and inner flat sections 144, 145. Radially adjacent ones 118 of the outer and inner flat sections 144, 145 of circumferentially adjacent ones 220 of the outer and inner heat shields 110, 111 generally meet at a corner intersection 148. Flat intersecting corners 150 of these outer and inner flat sections 144, 145 are located at the corner intersection 148.

Local corner flow recirculation zones are formed along the flat intersecting corners 150 and the flat corners 160 during engine operation. Such local corner flow recirculation zones do not exist in the conical outer and inner heat shields in the combustor dome disclosed in U.S. Pat. No. 8,596,071. The corner recirculation zones 149 improve flame stability and anchoring, and have been shown to eliminate dynamics or noise and reduce CO and VOC emissions in certain gas turbine engine combustors. The conical-flat heat shield disclosed herein can significantly reduce combustion instability and emissions of NOx, CO and HC.

Referring to FIGS. 1 and 2, the outer and inner heat shields 110, 111 are separate discrete shield members. In the exemplary embodiment of the heat shields and domeplate illustrated in FIGS. 1 and 2, the outer and inner heat shields 110, 111 are removably coupled or mounted to and downstream from the domeplate 50 such that gases discharged from the premixer cavities 74, 78 are directed downstream and radially inwardly along conical surfaces 114 of the outer and inner conical sections 142, 143 of the outer and inner heat shields 110, 111 respectively. The outer and inner heat shields 110, 111 are mounted within combustor 16 to the outer and inner liners 32, 34, respectively, such that inner mixer assembly 38 is substantially centered within inner heat shield 111, and outer mixer assembly 39 is substantially centered within outer heat shield 110. The outer heat shield 110 is positioned substantially circumferentially around at least one outer mixer assembly 39, and the inner heat shield 111 is positioned substantially circumferentially around at least one inner mixer assembly 38. More specifically, in the exemplary embodiment, at least one mixer assembly 38 extends through opening 116 in heat shield 111, and at least one mixer assembly 39 extends through opening 116 in heat shield 110.

The pilot inner swirlers 62, 65, pilot outer swirlers 64, 67, and main mixers 41, 44 are designed to effectively mix fuel and air. Pilot inner swirlers 62, 65, pilot outer swirlers 64, 67, and main mixers 41, 44 impart angular momentum to a fuel-air mixture causing the fuel-air mixture to rotate or swirl around the mixer assemblies 38, 39. After the fuel-air mixture flows from each mixer assembly 38, 39, the mixture continues to swirl about the outer and inner centerlines 53, 52 through the outer and inner conical sections 142, 143 of the outer and inner heat shields 110, 111 up to the outer and inner flat sections 144, 145 respectfully. The annular outer and inner conical sections 142, 143 are centered about the outer and inner centerlines 53, 52 and have outer and inner half cone angles 153, 152 with respect to the outer and inner centerlines 53, 52 respectfully.

Swirling fuel-air mixture from the main mixer 44 flows along the conical surfaces 114 of the outer and inner conical sections 142, 143 of the outer and inner heat shields 110, 111 respectively. The small outer and inner half cone angles 153, 152 generate high velocity gradients so that the fuel-air mixture cannot be ignited over the conical surfaces 114 under any conditions. As the fuel-air mixture flows past the heat shield, the fuel-air mixture is ignited at convex corners 170 between the outer and inner conical sections 142, 143 and the outer and inner flat sections 144, 145 of the outer and inner heat shields 110, 111 respectively.

The flow field inside combustion chamber 30 inhibits shedding of large-scale vortices from mixer assemblies 38, 39. In the absence of flame-vortex interactions, heat release due to combustion is steadier and less prone to amplify pressure oscillations inherent in turbulent combustion. This behavior facilitates reduced acoustic magnitudes, improved operability, and increased durability of combustor components.

The conical-flat outer and inner heat shields 110, 111 may be fabricated from materials that retain sufficient strength at high temperatures. The conical-flat outer and inner heat shields 110, 111 may be film cooled. Illustrated in FIGS. 11 and 12 is an exemplary means for film cooling the conical-flat outer and inner heat shields 110, 111. Though the film cooling means is illustrated for just the conical-flat outer heat shields 110 it may also be used for the inner heat shield. Upstream angled film cooling holes 180 or slots or other film cooling apertures may be used for cooling a downstream facing conical surface 114 of the outer and inner conical sections 142, 143 of the outer and inner heat shields 110, 111 respectively. Cooling air 182 passes through impingement and supply holes 184 through a cool wall 190 into a cooling air plenum 186 within the conical section. The upstream angled film cooling holes 180 direct film cooling air 188 from inside the cooling air plenum 186 through a hot wall 192 onto and downstream along the downstream facing conical surface 114 of the outer and inner transition sections 126, 127.

As illustrated in FIG. 13, the outer and inner conical sections 142, 143 of the conical-flat outer and inner heat shields 110, 111 may have downstream or aft outer and inner bent portions 132, 133 with outer and inner bent centerlines 134, 135 respectively. The design or shape of the outer and inner bent portions 132, 133 may be conical having outer and inner half aft cone angles 136, 137 with respect to the outer and inner bent centerlines 134, 135 respectively. The value of the outer and inner half aft cone angles 136, 137 may be the same as the outer and inner half cone angles 153, 152 of the annular outer and inner conical sections 142, 143.

This may be designed by rotating location of the outer and inner flat sections 144, 145 about outer and inner points 138, 139 on the circular outer and inner rims 156, 158 of the outer and inner conical sections 142, 143. This forms the outer and inner bent centerlines 134, 135 having outer and inner bend angles 234, 235 with respect to the outer and inner centerlines 53, 52 and outer and inner tilt angles 236, 237 of the outer and inner flat sections 144, 145 with respect to outer and inner planes 241, 243 normal to the outer and inner centerlines 53, 52 respectfully.

The heat shield described herein may be utilized on a wide variety of gas turbine engines. The above-described heat shield and mixer assemblies improve combustor durability by reducing acoustic amplitudes and heat shield thermal stresses. Exemplary embodiments of a heat shield and mixer assemblies are described above in detail. The heat shield and mixer assemblies are not limited to the specific embodiments described herein. Specifically, the above-described heat shield is cost-effective and highly reliable, and may be utilized on a wide variety of combustors installed in a variety of gas turbine engine applications.

Figure 15:
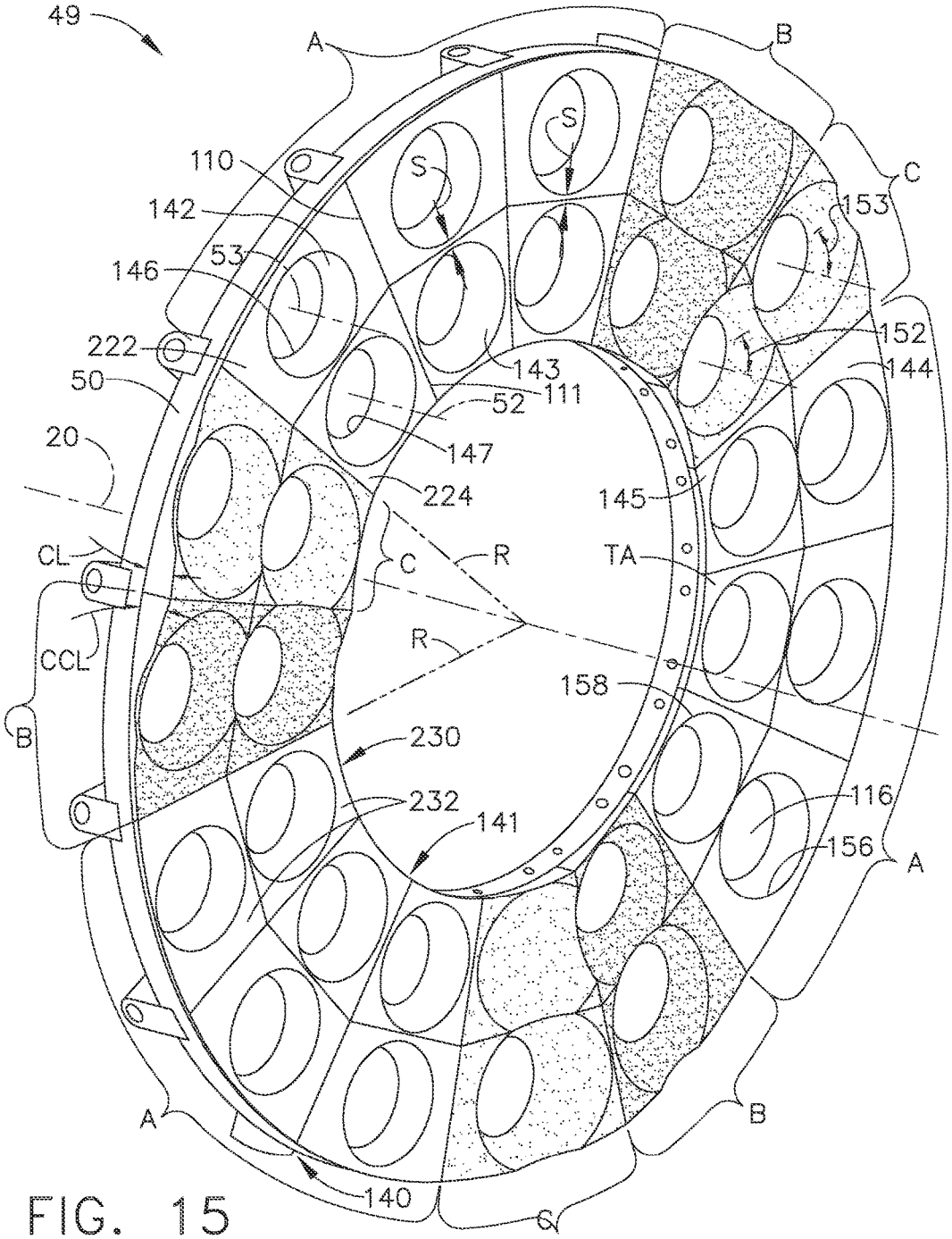
FIG. 15 is an elevated aft looking forward schematical view illustration of a circumferentially mixed arrangement of the radially inner and outer heat shields illustrated in FIG. 1.

The conical-flat outer and inner heat shields 110, 111 may be arranged in a non-symmetrical or asymmetrical pattern within one or both (or more) of the outer and inner circular rows 140, 141 respectively as illustrated in FIG. 15 for acoustics abatement. At least two sets of pairs 232 of radially adjacent conical-flat outer and inner heat shields 110, 111 have different heat shields in each or both of the outer and inner circular rows. Illustrated in FIG. 15 are three groups (first, second, and third groups A, B, C) of sets 230 of radially adjacent pairs 232 of conical-flat outer and inner heat shields 110, 111.

The group A is illustrated herein as including three sets 230 and each set 230 is illustrated as including three pairs 232 of radially adjacent pairs of inner heat shields 110, 111. The groups B and C are each illustrated herein as including three sets 230 of one radially adjacent pair 232 of conical-flat outer and inner heat shields 110, 111. The pairs 232 of radially adjacent conical-flat outer and inner heat shields 110, 111 in each of the first, second, and third groups A, B, C is different from the conical-flat outer and inner heat shields 110, 111 in each of the other groups. Each group is also representative or illustrates a sector of the dome 46 containing the conical-flat outer and inner heat shields 110, 111 and the domeplate 50 upon which the conical-flat outer and inner heat shields 110, 111 are mounted or to which they are coupled.

Each of the first, second, and third sectors or groups A, B, C may have different design parameters, dimensions, or features. Among the design parameters or dimensions that may be different are: total area TA of the flat downstream facing surfaces 222 along the outer and inner flat sections 144, 145 of each of the conical-flat outer and inner heat shields 110, 111; the outer and inner half cone angles 153, 152 of the outer and inner conical sections 142, 143; and radial spacing S between the outer and inner rims 156, 158 of the outer and inner conical sections 142, 143 at the outer and inner flat sections 144, 145 of each of the conical-flat outer and inner heat shields 110, 111.

Another exemplary asymmetry is illustrated in FIG. 15 is a circumferential tilt of the flat downstream facing surfaces 222 of the outer and inner flat sections 144, 145 about radii R normal to the engine centerline 20. Clockwise and counter-clockwise circumferential tilt angles CL, CCL of the flat downstream facing surfaces 222 of the outer and inner flat sections 144, 145 are illustrated for second, and third sectors or groups B, C respectively in FIG. 15.

Figure 16:
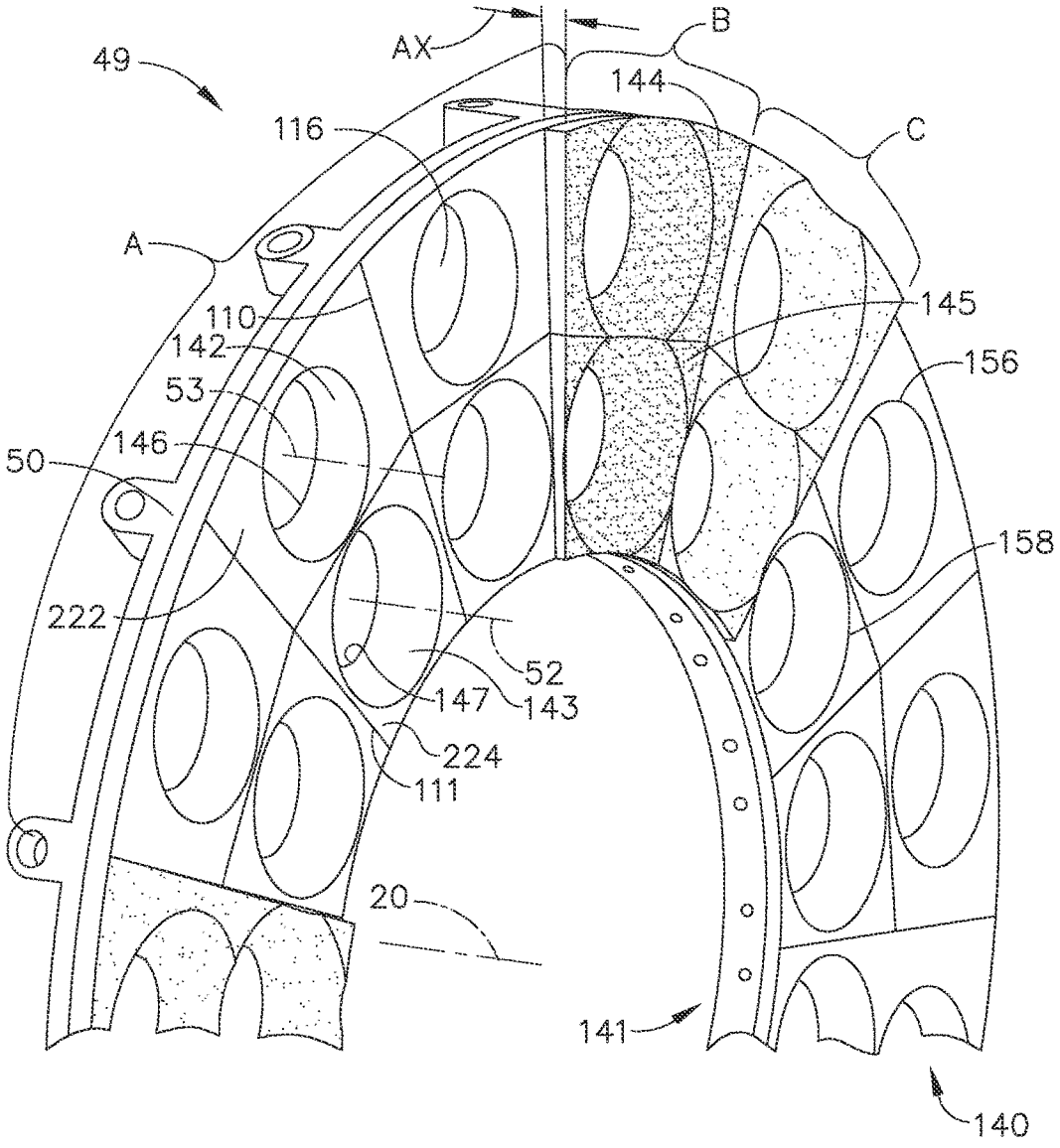
FIG. 16 is an elevated aft looking forward schematical view illustration of a circumferentially mixed and axially offset arrangement of the radially inner and outer heat shields illustrated in FIG. 1.

Illustrated in FIG. 16 is another exemplary asymmetry or design difference that may be used. The conical-flat outer and inner heat shields 110, 111 may have a circumferentially mixed and axially offset arrangement of the radially inner and outer heat shields may be used. Some of the groups may include an axial offset AX of the outer and inner flat sections 144, 145 of the conical-flat outer and inner heat shields 110, 111 from the domeplate 50. The exemplary embodiment of use of the axial offset AX is illustrated in FIG. 16 for the second and third groups B, C. Note, that different groups may have different design differences. For example, at least one the conical-flat outer and inner heat shields 110, 111 in one of the groups (i.e., group B) may have an axial offset AX but not other ones of the groups (i.e., groups A and C) and at least one the conical-flat outer and inner heat shields 110, 111 in another one of the groups (i.e., group C) may have a different design parameter than other ones of the groups (i.e., groups A and B).

Annular combustors with a different number of circular rows of conical-flat heat shields such as a single annular combustor (SAC) or a triple annular combustor (TAC) dome 46 may be used in a gas turbine engine combustor. For example, a single annular combustor (SAC) may have a single circular row of conical-flat heat shields mounted on a domeplate of the combustor. Another example may be a triple annular combustor (TAC) which may have three concentric circular rows of conical-flat heat shields mounted on a domeplate of the combustor. In yet another example, the conical section 142 is fully intact and is not cut off. In this embodiment the edges of downstream flat surface 222 of heat shield 110 are all straight, so that neither the outer nor the inner edge is partially circular. This can be seen in FIGS. 15 and 16.

While the invention has been described in terms of various specific embodiments, those skilled in the art will recognize that the invention can be practiced with modification within the spirit and scope of the claims.

What is claimed is:

1. A conical-flat heat shield for a combustor of a gas turbine engine, the conical-flat heat shield comprising:

a conical section extending upstream or forward from and being integral with a flat section of the conical-flat heat shield, the flat section including radially outer and inner edges, at least one of the radially outer and inner edges being circular and circumscribed about a centerline of the gas turbine engine, the flat section including circumferentially spaced apart radial edges having an origin on the centerline;

film cooling means for cooling a downstream facing conical surface of the conical-flat heat shield upstream or forward of the flat section.

2. The conical-flat heat shield as claimed in claim 1 further comprising a flat downstream facing surface of the flat section perpendicular to or canted at a face angle with respect to the centerline.

3. The conical-flat heat shield as claimed in claim 2 further comprising a cylindrical section upstream from and integral with the conical section.

4. The conical-flat heat shield as claimed in claim 2 further comprising:

a cooling air plenum disposed between a cool wall and a hot wall of the conical-flat heat shield upstream or forward of the flat section, cooling air supply holes extending through the cool wall to the cooling air plenum, and upstream angled film cooling holes extending from the cooling air plenum through the hot wall to a downstream facing surface of the conical-flat heat shield upstream or forward of the flat section.

5. The conical-flat heat shield as claimed in claim 1 further comprising:

a transition section disposed between and integral with the conical section and a cylindrical section, the cylindrical section extending upstream or forward from the conical section, and a forward end of the transition section flush with the cylindrical section and an aft end of the transition section flush with the conical section.

6. The conical-flat heat shield as claimed in claim 1 further comprising the flat section having flat corners with flat flame stabilizing corner surfaces.

7. The conical-flat heat shield as claimed in claim 6 further comprising the flat flame stabilizing corner surfaces being at least part of a flat downstream facing surface of the flat section perpendicular to or canted at a face angle with respect to a centerline.

8. The conical-flat heat shield as claimed in claim 7 further comprising a cylindrical section upstream or forward from and integral with the conical section.

9. The conical-flat heat shield as claimed in claim 8 further comprising a transition section disposed between the cylindrical section and the conical section.

10. The conical-flat heat shield as claimed in claim 9 further comprising:

a cooling air plenum disposed between a cool wall and a hot wall of the conical-flat heat shield upstream or forward of the flat section, cooling air supply holes extending through the cool wall to the cooling air plenum, and upstream angled film cooling holes extending from the cooling air plenum through the hot wall to a downstream facing surface of the transition section upstream or forward of the flat section.

11. A gas turbine engine combustor comprising:

a domeplate coupled to combustor outer and inner liners, one or more concentric circular rows of conical-flat heat shields mounted on or coupled to the domeplate, each of the conical-flat heat shields including a conical section extending upstream or forward from and integral with a flat section of the conical-flat heat shield;

the flat section including radially outer and inner edges, at least one of the outer and inner edges being circular and circumscribed about a centerline of a gas turbine engine, the flat section including circumferentially spaced apart radial edges having an origin on the centerline; and film cooling means for cooling a downstream facing conical surface of the conical-flat heat shield upstream or forward of the flat section.

12. The gas turbine engine combustor as claimed in claim 11 further comprising:

a flat downstream facing surface of the flat section perpendicular to or canted at a face angle with respect to the centerline.

13. The gas turbine engine combustor as claimed in claim 12 further comprising the flat section having flat corners with flat flame stabilizing corner surfaces and the flat flame stabilizing corner surfaces being at least part of the flat downstream facing surfaces.

14. The gas turbine engine combustor as claimed in claim 13 further comprising:

two or more groups of the conical-flat heat shields in the one or more circular rows of conical-flat heat shields, each of the conical-flat heat shields having one or more design parameters, and at least one of the conical-flat heat shields in a first one of the two or more groups having the one or more design parameters different than the one or more design parameters of the conical-flat heat shields in a second one of the two or more groups.

15. The gas turbine engine combustor as claimed in claim 14 further comprising the one or more design parameters chosen from a group consisting of:

total area (TA) of the flat downstream facing surfaces along the flat section of each of the conical-flat heat shields, half cone angle of the conical section, an axial offset (AX) of the flat section of the conical-flat heat shields from the domeplate, and clockwise and/or counter-clockwise circumferential tilt angles (CL, CCL) of the flat downstream facing surfaces of the flat sections.

16. The gas turbine engine combustor as claimed in claim 15 further comprising:

cooling air plenums disposed between a cool wall and a hot wall of the conical-flat heat shields upstream or forward of the flat sections, cooling air supply holes extending through the cool walls to the cooling air plenums, and upstream angled film cooling holes extending from the cooling air plenums through the hot walls to downstream facing surfaces of transition sections upstream or forward of the flat sections.

17. The gas turbine engine combustor as claimed in claim 13 further comprising:

cylindrical sections upstream from and integral with the conical sections;

the conical-flat heat shields including transition sections disposed between and integral with the conical sections and the cylindrical sections, the cylindrical sections extending upstream or forward from the conical sections, forward ends of the transition sections flush with the cylindrical sections, and aft ends of the transition sections flush with the conical sections.

18. The gas turbine engine combustor as claimed in claim 17 further comprising:

cooling air plenums disposed between cool walls and hot walls of the conical-flat heat shields upstream or forward of the flat sections, cooling air supply holes extending through the cool walls to the cooling air plenums, and upstream angled film cooling holes extending from the cooling air plenums through the hot walls to downstream facing surfaces of the transition sections upstream or forward of the flat sections.

19. A combustor of a gas turbine engine, the combustor comprising:

two or more concentric circular rows of conical-flat outer and inner heat shields coupled to or mounted on a domeplate of the combustor, the two or more concentric circular rows including at least one pair of radially adjacent outer and inner circular rows of the conical-flat outer and inner heat shields, the conical-flat outer and inner heat shields including outer and inner conical sections extending upstream or forward from and integral with outer and inner flat sections of the conical-flat outer and inner heat shields respectfully; and flat downstream facing surfaces of the outer and inner flat sections perpendicular to or canted at a face angle with respect to a centerline of the gas turbine engine, the flat downstream facing surface of a first one of the outer and inner flat sections canted at a first face angle towards the centerline and the flat downstream facing surface of a second one of the outer and inner flat sections canted at a second face angle away from the centerline.

20. The gas turbine engine combustor as claimed in claim 19 further comprising:

two or more groups of the conical-flat outer and inner heat shields in the two or more concentric circular rows, each of the conical-flat outer and inner heat shields having one or more design parameters, and at least one of the two or more groups including the outer and inner conical-flat heat shields having at least one of the one or more design parameters different than the one of the one or more design parameters in others of the two or more groups.

21. The gas turbine engine combustor as claimed in claim 20 further comprising the one or more design parameters being chosen from a group consisting of:

total area (TA) of the flat downstream facing surfaces along the outer and inner flat sections of each of the conical-flat outer and inner heat shields respectively, outer and inner half cone angles of the outer and inner conical sections respectively, radial spacing (S) between outer and inner rims of the outer and inner conical sections at the outer and inner flat sections of radially adjacent ones of the conical-flat outer and inner heat shields respectively, an axial offset (AX) of the outer and inner flat sections of the conical-flat outer and inner heat shields respectively from the domeplate, and clockwise and/or counter-clockwise circumferential tilt angles (CL, CCL) of the flat downstream facing surfaces of the outer and inner flat sections.

22. A combustor of a gas turbine engine, the combustor comprising:

two or more concentric circular rows of conical-flat outer and inner heat shields coupled to or mounted on a domeplate of the combustor, the two or more concentric circular rows including at least one pair of radially adjacent outer and inner circular rows of the conical-flat outer and inner heat shields, and the conical-flat outer and inner heat shields including annular outer and inner conical sections extending upstream or forward from and integral with outer and inner flat sections of the conical-flat outer and inner heat shields respectfully, and flat downstream facing surfaces of the outer and inner flat sections perpendicular to or canted at a face angle with respect to a centerline of the gas turbine engine, the flat downstream facing surface of a first one of the outer and inner flat sections canted at a first face angle with respect to the centerline and the flat downstream facing surface of a second one of the outer and inner flat sections canted at a second face angle with respect to the centerline.

* * * * *